US005904470A

United States Patent [19]

Kerrebrock et al.

[11] Patent Number: 5,904,470

[45] Date of Patent: May 18, 1999

[54] COUNTER-ROTATING COMPRESSORS WITH CONTROL OF BOUNDARY LAYERS BY FLUID REMOVAL

[75] Inventors: Jack L. Kerrebrock, Lincoln; Alan H. Epstein, Lexington, both of Mass.

[73] Assignee: Massachusetts Institute of Technology, Cambridge, Mass.

[21] Appl. No.: 08/791,057

[22] Filed: Jan. 13, 1997

[51] Int. Cl.[6] ..... F04D 29/38

[52] U.S. Cl. ..... 415/115; 415/914

[58] Field of Search ..... 416/128, 129; 415/914, 115, 116

[56] References Cited

U.S. PATENT DOCUMENTS

| | | | |
|---|---|---|---|
| 3,993,414 | 11/1976 | Meauze et al. | 415/914 |
| 4,809,498 | 3/1989 | Giffin, III et al. | 416/129 |
| 4,957,410 | 9/1990 | Silvestri, Jr. | 415/914 |
| 5,232,338 | 8/1993 | Vincent De Paul et al. | 415/914 |
| 5,568,724 | 10/1996 | Lindner et al. | 415/914 |

FOREIGN PATENT DOCUMENTS

| | | | |
|---|---|---|---|
| 1938132 | 1/1971 | Germany | 415/914 |
| 619722 | 3/1949 | United Kingdom | 415/914 |

*Primary Examiner*—John T. Kwon
*Attorney, Agent, or Firm*—Cantor Colburn LLP

[57] ABSTRACT

Improved performance of counter-rotating turbo machines and compressors. An increase in the thermodynamic efficiency of the compression process is obtained by removing the boundary layer in locations where separation is likely to occur.

7 Claims, 7 Drawing Sheets

COUNTER-ROTATING COMPRESSORS WITH CONTROL OF BOUNDARY LAYERS BY FLUID REMOVAL

BACKGROUND OF THE INVENTION

1. Field of the Invention

The invention relates to the field of turbomachines and compressors. More particularly, the invention relates to improving the pressure ratio obtainable by a turbomachine or compressor having a given blade speed and number of stages of compression and to increasing the thermodynamic efficiency of the turbomachine or compressor.

2. Prior Art

Thought about fluid dynamics and invention pertaining thereto has existed for a substantial period of time. So too has man's interest in creating power persevered. One of the arts in which substantial and powerful thought has been devoted to is that of compressors and turbomachines. One of the most important areas driving such research is aeronautics and astronautics for both the commercial interests of high speed transportation and military interests for defense and the exploration of space. Some important issues with respect to the advance of compressors and turbomachines is the pressure ratio attainable and the efficiency of the machines.

Reissue U.S. Pat. No. 23,108 to E. A. Stalker discloses the provision of slots located well rearward on the blade to increase the effectiveness of the blade. This is taught in order to control the boundary layer on the blades of blowers and compressors to better enable the machine to run at lower than optimal speeds.

J. R. Irwin, U.S. Pat. No. 2,720,356 imposes continuous boundary layer control for compressors by moving the boundary layer through porous surfaces. The teaching recommends to then reintroduce the viscous interactive flow to the main flow of the compressor at a later stage.

U.S. Pat. No. 2,749,025 to Stalker focuses primarily on providing blades of later stages in a compressor with progressively larger radii rounded leading edges. This reduces losses associated with the flow angle into these blades which would normally be experienced at below optimum speeds. The substantially semi-circular nose cross-section is professed to be able to smooth the flow and avoid burbling when the approach vectors are far from optimum. A further step to assist the machine in these conditions is to remove the boundary layer in this area.

U.S. Pat. No. 3,694,102 to Conrad teaches use of suction slots in stator blades to prevent separation of the boundary layer in supersonic blading. Conrad, however, fails to recognize the benefit of removing the boundary layer permanently from a compressor. This is evidenced by equating bleeding of the boundary layer to atmosphere to reintroducing the boundary layer into the compressor at another stage.

U.S. Pat. No. 3,993,414 to Meauze discloses an axial supersonic compressor comprising a casing and a hub rotating in the casing and carrying blades. On each of the suction surfaces of the blades is formed a zone in which the curvative changes and which corresponds to a supersonic subsonic shock wave. A channel formed in each blade and opening in the zone is connected to a boundary layer aspiration means.

U.S. Pat No. 3,897,168 to Amos and U.S. Pat No. 4,595,339 to Naudet both disclose the recapture of energy from a withdrawn boundary layer to avoid losses.

U.S. Pat No. 3,385,509 to Garnier discloses an engine with counter-rotating compressor blades and counter-rotating turbine blades. Nozzle flow area of the turbines is adjusted to control the boundary layer by either moving the stators or by blowing through slots in their surfaces. Gamier is silent however on removing the boundary layer from the flow permanently.

None of the prior art discussed provides insight to the thermodynamic benefits of fluid removal from the flow path. In fact, many of skill in the prior art believed that reintroducing the fluid of the viscous interaction to the flow path at another compressor stage was beneficial to the functioning of the machine.

It is well known in the prior art to construct compressors and turbomachines having counter-rotating blades. However, counter-rotating machines have never been as useful as they should be in view of the better compression attainable with counter-rotating blades as opposed to alternating rotating and stator blades because of mechanical factors which limited the total attainable pressure to levels not commercially viable. Unfortunately, mechanical arrangements do not exist to enable the use of more than two counter-rotating blade rows, all with high blade speeds. Prior conceptions of counter-rotating compressors have had one set of rotating blades mounted on a rotating casing, rather than a hub. This limits their blade speed. Therefore, the machines have been disappointing. Providing a means to make these machines function better would be an important advance to the industry primarily because they are less expensive to manufacture and weigh less than conventional machines.

SUMMARY OF THE INVENTION

The above-discussed and other drawbacks and deficiencies of the prior art are overcome or alleviated by the teachings of the present invention.

By providing structure capable of removing the boundary layer of fluid in a turbomachine or compressor anywhere in the machine where viscous interaction limits the diffusion in the flow passages, the pressure ratio attainable for a given machine and the thermodynamic efficiency thereof are greatly enhanced.

Implementation of fluid removal is accomplished by employing a variety of removal structures within the machine either alone or in combination depending upon the areas affected by viscous interaction and the desired improvement of the system. As will be recognized by one of ordinary skill in the art, the areas of viscous interaction (or boundary layer) cause the flow to fail to follow the surfaces of the machine. This contributes to further entropy in the system and thus loss of efficiency and of output of the machine. The present invention employs scoops, slots, porous surfaces and/or other equivalent means to remove the boundary layer and a passage through the blade to transport the fluid to an end use thereof. Whether the boundary layer fluid is removed to the internal cavity of the blade or to channels in the outer housing the fluid is employed in some way and is not reintroduced into the flow. This minimizes losses and can aid in cooling, operating accessory tools, etc. In the case of the fluid entering the space within a hollow blade, the fluid may be expressed outwardly or inwardly with differing effects on the machine.

As indicated above, optimum benefits are achieved by removing the boundary layer anywhere in the machine where viscous interactions tend to promote separation of the fluid. Some of the locations (not an exhaustive list) in which such boundary layer removal is beneficial are at a location on the blade near the trailing edge on the convex or suction side; on the casing; ahead of a rotor or a stator; on the hub; ahead of any shock impingement area and at blade tips (to avoid vortex blockage).

Removal of the boundary layer and its deposition in a location other than in the flow of the machine is particularly beneficial to improving the efficiency and output of counter-rotating machines. Boosting pressure ratio attainable and efficiency in counter-rotating machines which generally have only two rotating blade rows makes these machines competitive with much larger, heavier and more costly machines. This is a significant advance in the art.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

It is important to note at the outset that the inventors hereof recommend employing means to remove the boundary layer at all areas of potential separation to provide optimum performance, however it should also be noted that incremental gains are obtained with each removal area.

Figure 1:
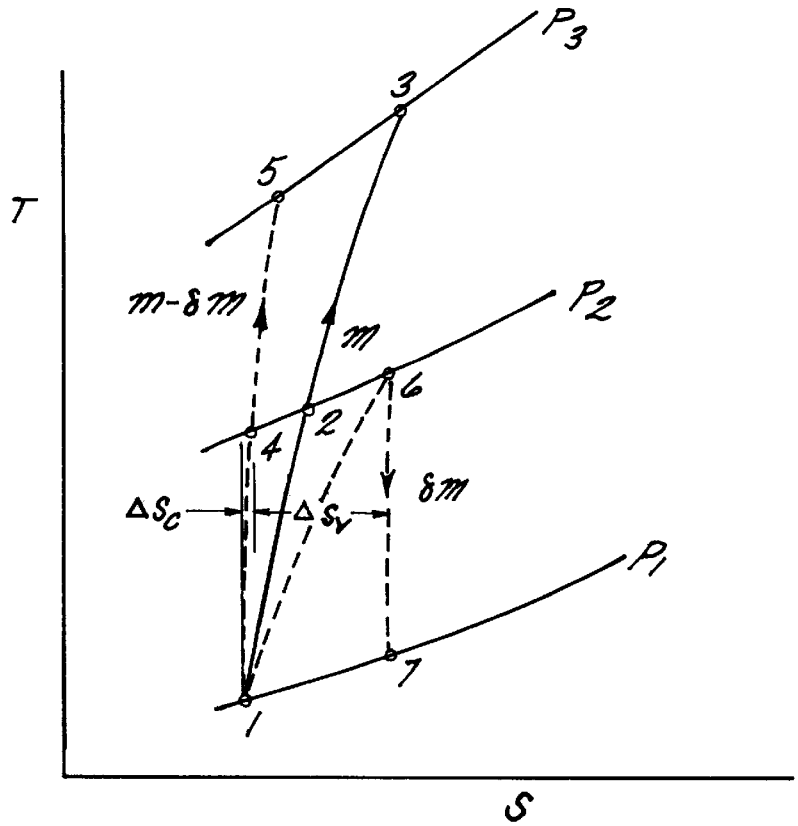
FIG. 1 is a thermodynamic representation of the effect of high-entropy fluid removal on compression efficiency.

With respect to efficiency of compressors and other turbomachines, it is conventional in fluid-thermodynamic discussions of compression and expansion processes to represent the deviation of the process by an increase in the entropy of the fluid, denoted S. The entropy is related to the pressure and temperature, for a thermally and calorically perfect gas, by the relation $$S_2 - S_1 = C_p \ln\left(\frac{T_2}{T_1}\right) - R\ln\left(\frac{P_2}{P_1}\right)$$

where the subscripts 1 and 2 denote the beginning and end states of the fluid undergoing the process. The compression process may then be represented by a trace on temperature entropy coordinates. Such a representation of the processes under discussion is shown in FIG. 1. State 1 is at $P_1$, $T_1$. $S_1$ is the beginning of the compression process and the desired end pressure is $P_3$. For purposes of this discussion, the fluid is assumed to be removed from the flow path at the pressure $P_2$, which may have any value between the inlet and delivery pressures.

A conventional compression process is represented by the full-line trace from points 1 to 3, which shows the entropy increase due to viscous effects that results from mixing of the high-entropy fluid in the boundary layers with the remainder of the flow. With fluid removal, the high entropy fluid, at state 6, is separated from the remainder of the flow, at state 4, and removed from the flow path. The fluid remaining in the flow path then has the entropy corresponding to point 4, lower than it would have at point 2 if the high entropy fluid of the boundary layer were reintroduced into the flow path as was the conventional way. After the removal, the high-entropy fluid is expanded to recover its available energy, while the remainder is compressed to the desired end state at $P_3$. Since its entropy is lower at the end state than for a conventional process, the compression work is less, as represented by the fact that $T_5<T_3$.

Figure 2:
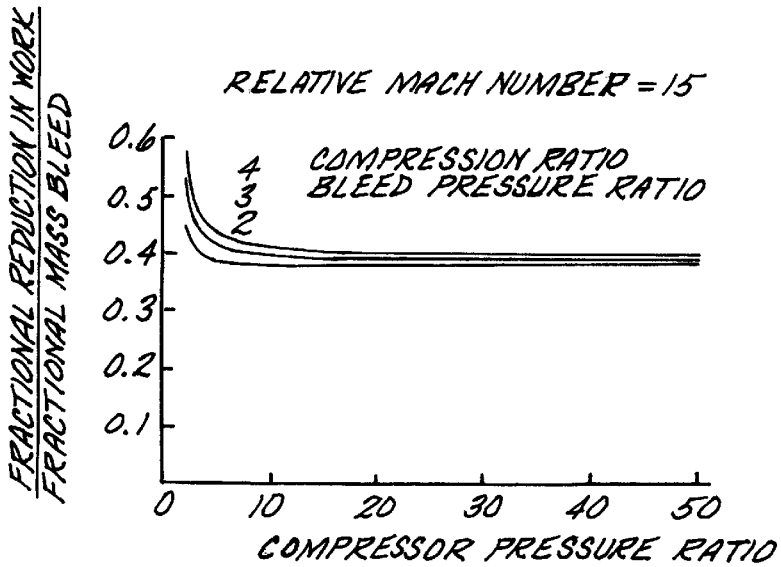
FIG. 2 is a graph plotting fractional reduction in work (or fractional increase in efficiency) per fraction of fluid removed.

The fractional reduction in compression work per unit of delivered fluid is given by the relation $$\frac{\frac{W_{nb}}{m} - \frac{W_b}{(m-\delta m)}}{\frac{W_{nb}}{m}} = \left(\frac{\delta m}{m}\right)\left\{\frac{\gamma-1}{2}M^2 - \left(1+\frac{\gamma-1}{2}M^2\right)\left[\frac{\left(\frac{P_2}{P_1}\right)^{\frac{\gamma-1}{\gamma}\left(\frac{1}{\eta_p}-1\right)} - 1}{\left(\frac{P_3}{P_1}\right)^{\frac{\gamma-1}{\gamma\eta_p-1}}}\right]\right\}$$

where the subscript b refers to "with bleed" i.e. with fluid removal, while nb is without fluid removal. M is the relative Mach number of the flow to the surface at which removal is done, and $\eta_p$ is the Polytropic efficiency of the overall compression process. This result shows that the gain in efficiency due to fluid removal increases with increasing M and depends on the overall compression ratio and the compression ratio at the point of removal. As an example, this latter dependence is illustrated for M=1.5 in FIG. 2. It shows that the gain in efficiency is about one half percent for each percent of (high entropy) fluid removal.

While efficiency is always important in an environment of costly energy, of even more importance is that the invention enables a higher pressure ratio or pressure rise for given machine parameters. Therefore smaller, lighter machines may be employed where only larger, heavier machines have been indicated in the past. This is clearly a significant benefit regardless of the application. Moreover, when coupled with the largest most powerful compressors and turbo machines the invention allows them to produce at an unprecedented level.

In order to provide one of ordinary skill in the art a full understanding of the invention, four points of boundary layer removal and transport methods are discussed hereunder. These are to be understood to be examples and do not limit the areas in which the present invention is employable and/or is beneficial.

Figure 3:
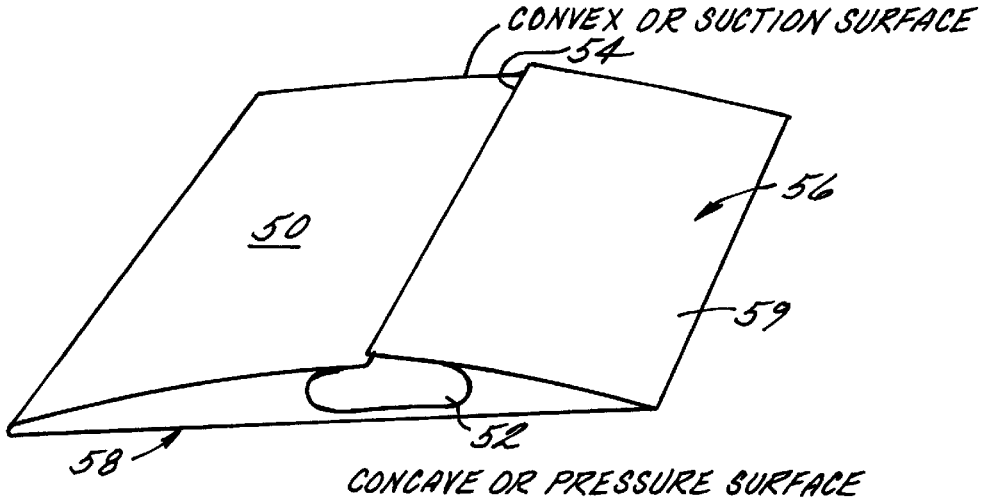
FIG. 3 is a perspective schematic view of a scooped blade embodiment of the invention.
Figure 4:
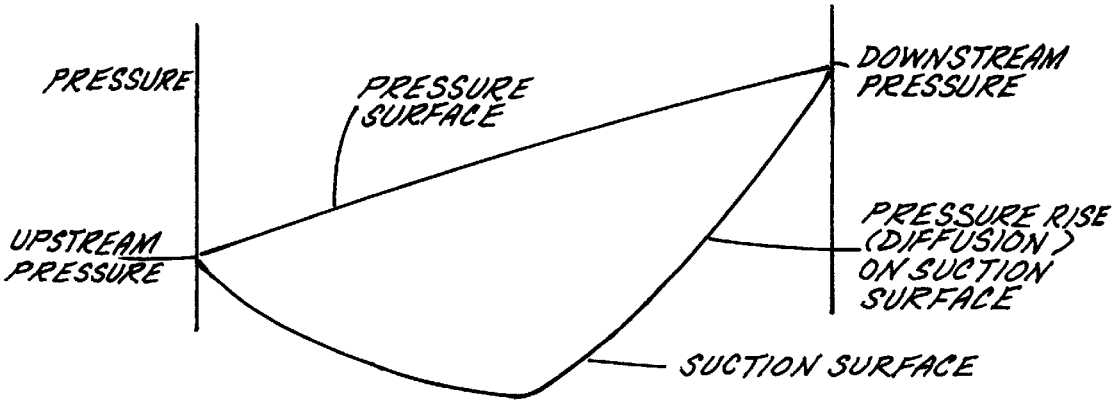
FIG. 4 is a graphic representation of the pressure distribution on a compressor blade.

Referring to FIGS. 3 and 4, a section of a blade 50 is schematically illustrated wherein a hollow core 52 is accessed through a scoop 54 (it should be noted that the scoop can also take the form of a slot or a porous structure or any equivalent structure capable of removing the boundary layer). The blade is, for most of its design parameters, conventional, having a convex or suction side 56 and a concave or pressure side 58. The convex side, of course, tends toward the upstream end of the machine while the concave side tends toward the downstream end of the machine. These design parameters cause air on the intake (convex) side to move more quickly and have a lower pressure while the convex side moves less quickly and has a higher pressure. As the compression fluid moves toward the trailing area 59 of the blade on the convex side, however, the pressure of the fluid rises rapidly to meet the pressure coming off the trailing area of the concave side. The rapid pressure rise causes separation of the boundary layer. This leads to increased entropy and reduced deflection. It is, therefore, beneficial to remove the boundary layer at a location just ahead of the expected separation. This creates a thinner boundary layer and higher wall shear stress thus increasing the attainable pressure rise.

The location of boundary layer removal for optimum performance is just ahead of or in the region of most rapid pressure rise.

As will be appreciated by those skilled in the art, compressors and other turbomachines can be transonic such that tips of the rotor blades exceed the speed of sound while the hub ends of the blades are subsonic. Machines subjected to this condition suffer from shock impingement on the blades' surfaces that generates a sudden pressure rise in the immediate vicinity of the impingement. The pressure rise can cause the boundary layer to separate which is known from the foregoing to be counterproductive to both efficiency and attainable pressure ratio.

Figure 5:
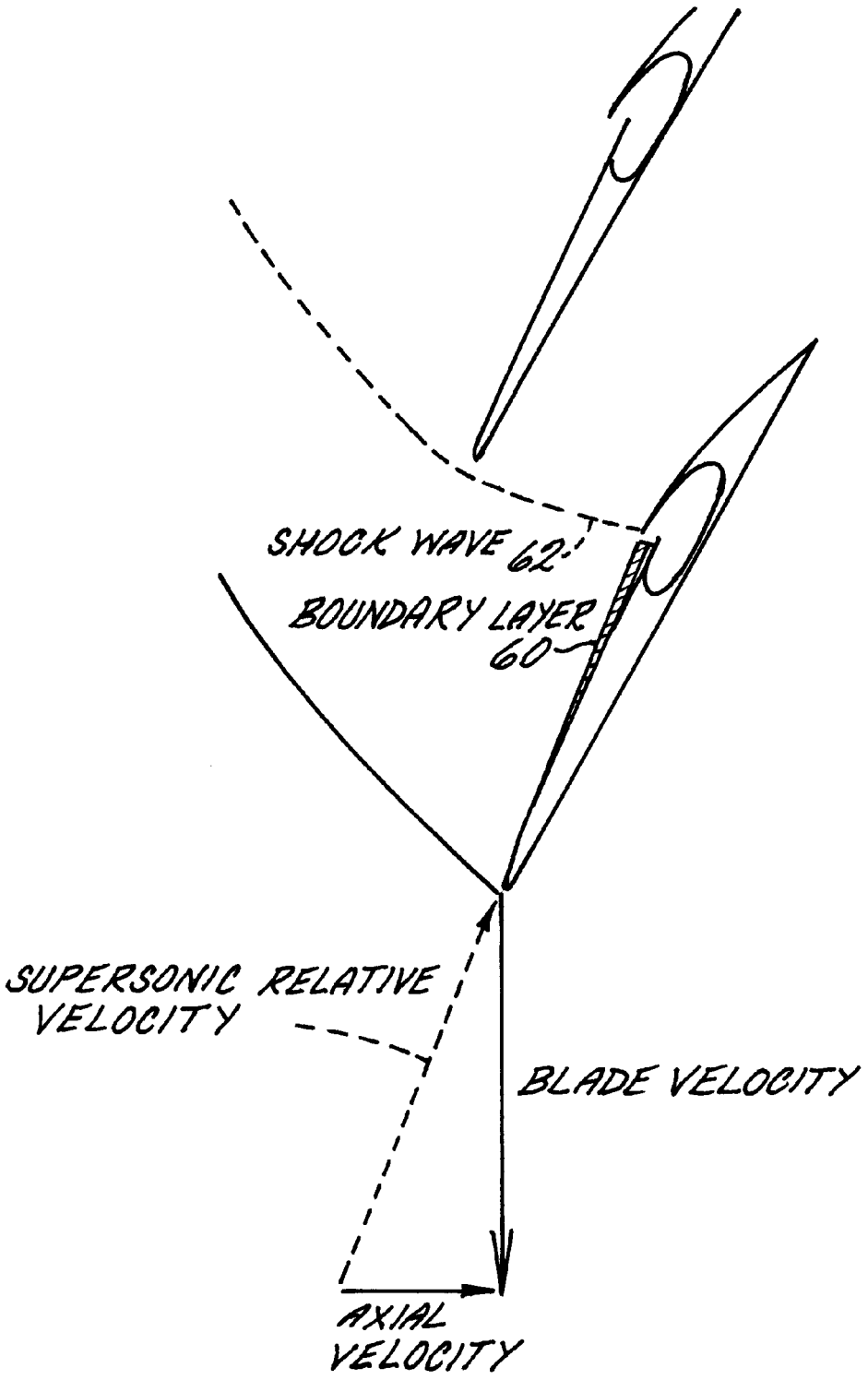
FIG. 5 is a schematic representation of a shock wave impingement on a blade row and the removal of boundary layer by scoop.

To alleviate the separation, the boundary layer immediately upstream of the shock impingement location is removed (See FIG. 5). By removing the boundary layer 60 upstream of the shock impingement 62 the boundary layer thickness at shock impingement is minimized. Thus separation and, increased entropy are avoided and the flow follows surfaces as intended.

Another area of the compressor which traditionally has been a limiting factor on attainable diffusion and thus performance of the machine is the viscous interaction or boundary layer on the cylindrical outer housing of the machine. As hereinbefore stated, sudden or rapid pressure increases in relatively small areas cause separation of the flow from the boundary layer in that area and contribute to greater entropy/less diffusion of the system. Blades passing closely over discrete areas of the outer housing cause shock pressure changes and the attendant separation. Removing the boundary layer on the housing immediately upstream of the close tolerance area of the rotating blades or the stator blades alleviates the problem.

Figure 6:
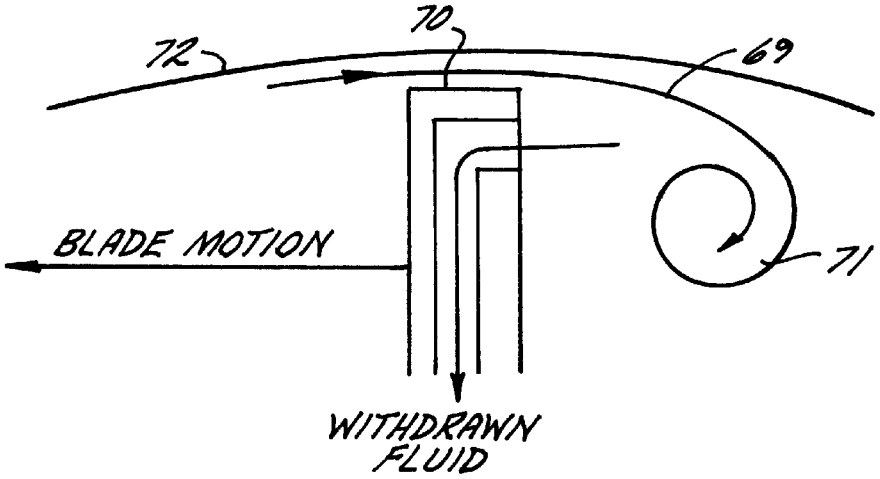
FIG. 6 is an axial schematic view of a Tip Vortex Blockage.
Figure 7:
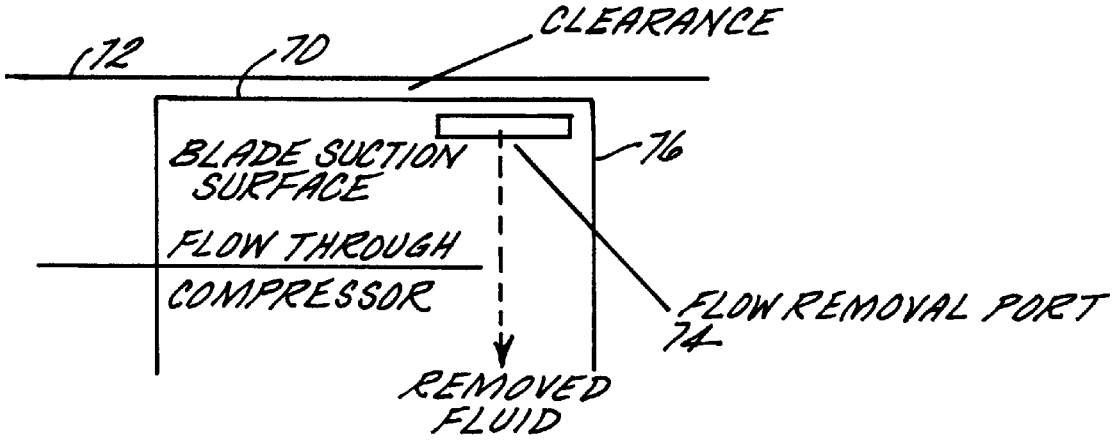
FIG. 7 is a schematic view of a removal location for boundary control to prevent Tip Vortex Blockages.

Removal of the boundary layer according to the invention is also beneficial to negate the phenomenon known as Tip Vortex Blockage which is itself, again, an increase in entropy and decrease in diffusion, thus limiting effectiveness of the machine. Tip Vortex Blockage is illustrated schematically in FIG. 6; the solution in FIG. 7. As will be appreciated following perusal of FIG. 6, the narrow tolerance between blade tips 70 and casing 72 and the pressure differential of the high and low pressure sides of the rotor, a jet of fluid 69 issues from the clearance and tends to roll into a vortex 71 with its axis aligned to the main flow direction. The vortex accelerates the main flow, reducing its diffusion and thus reducing efficiency and output.

The blockage is avoided by placing a flow removal port 74 in the suction surface of the blade near the trailing edge 76 thereof, thereby mitigating the effect of the vortex.

Figure 8:
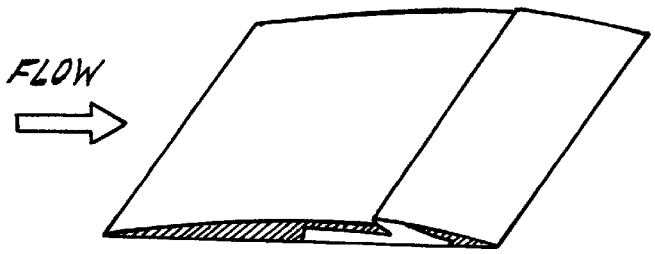
FIG. 8 is a schematic perspective view of a scoop blade embodiment of the invention.
Figure 9:
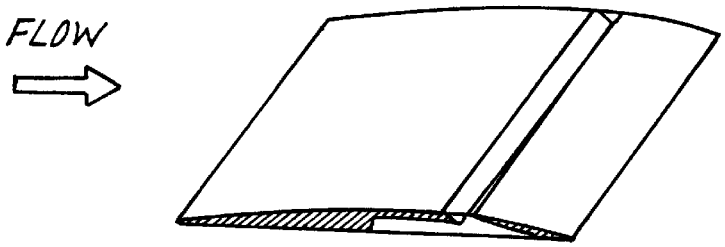
FIG. 9 is a schematic perspective view of a slot blade embodiment of the invention.
Figure 10:
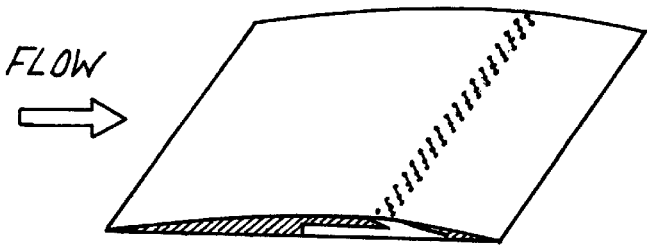
FIG. 10 is a schematic perspective view of a porous surface blade embodiment of the invention.

All of the removals of the boundary layer taught hereinabove can be accomplished by providing a scoop (most preferred) (see FIGS. 3, 5 and 8) a slot (see FIG. 9) and perforated structure (see FIG. 10) regardless of where in the machine the viscous interaction is being removed.

As one of skill in the art will recognize, although removing the viscous layer produces gains from the reduction of separation, there are losses associated therewith due to the removal of fluid upon which work has been expended. In order to alleviate the losses experienced, the inventors hereof have devised particular transport parameters and paths for the fluid. By transporting the boundary layer in certain ways to certain places, much of the work done on that fluid can be recaptured.

Figure 11:
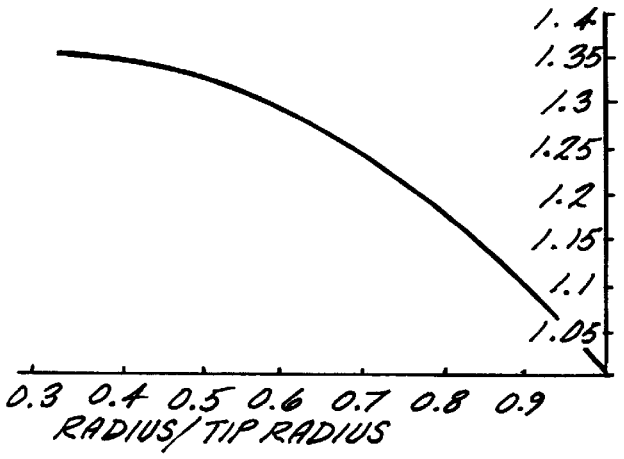
FIG. 11 is a graph of the variation with radius of ratio of blade-relative stagnation pressure to passage pressure.

Each of the exemplified means for removing the boundary layer preferably lead to a radially oriented passage that carries the flow to either the root or the tip of the blade. In the most preferred embodiment a single radially oriented passage is provided which communicates with the boundary layer catching structure. While it may appear that pressure would build in the passage and prevent flow thereinto of the boundary layer, the concept is enabled by the matching of the pressure variation in the passage, due to centrifugal gradient, to the variation of the stagnation pressure relative to the moving blade. The scoop configuration is most preferred because it recovers in the capture fluid, some of the stagnation pressure of that fluid relative to the blade. In the case of rotating blades, this relative stagnation pressure increases with radius because of the increasing tangential speed of the blade. Thus, the stagnation pressure approximately matches the variation of pressure in the radial passage. The variation of the ratio of the stagnation pressure to the passage pressure with radius is shown in FIG. 11 for the situation where the axial Mach number in the compressor is $M_x$=0.5 and the tip tangential Mach number of the rotating blades at their tip is $M_T$=1.5.

Calculation of the parameters is accomplished by the equation:

$$\frac{P_t}{P_{\text{passage}}} = \exp\left[\frac{\gamma M_T^2}{2}\left(1-\left(\frac{r}{r_T}\right)^2\right)\right]\left[\frac{1+\frac{\gamma-1}{2}M_x^2+\frac{\gamma-1}{2}M_T^2\left(\frac{r}{r_T}\right)^2}{1+\frac{\gamma-1}{2}M_x^2+\frac{\gamma-1}{2}M_T^2}\right]^{\frac{\gamma}{\gamma-1}}$$

where $r_T$ is the tip radius of the compressor and the pressure ratio is set at unity at that radius. This shows that the stagnation pressure differs from the pressure in the passage by only a small fraction over the radial extent of the blade, so that a single passage suffices for fluid removal at all radii.

Figure 12:
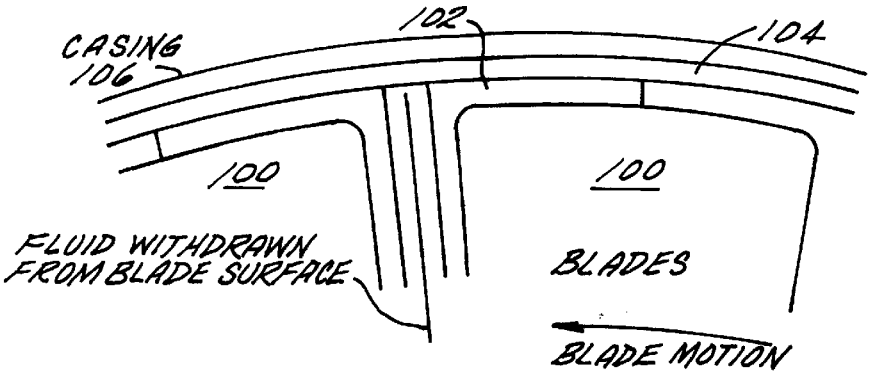
FIG. 12 is an axial view of a shroud embodiment of the invention.
Figure 13:
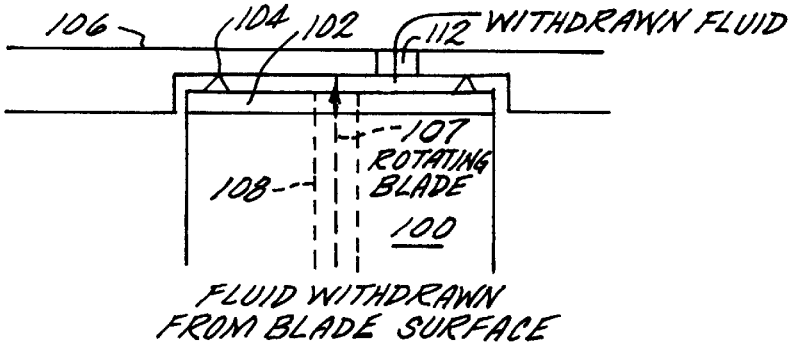
FIG. 13 is a tangentive view of FIG. 12.

As stated above, transport may be toward the root or the tip of the blade. Transport to the root and through the hub of the blades provides the significant advantage that part of the energy expended to bring the fluid to blade speed can be recaptured by channeling that energy back into the rotor. Collected boundary layer fluid is then most preferably directed to other areas of the machine and not reintroduced to the flow. Such fluid may be used for cooling or running accessory equipment.

Where the viscous fluid is transported outwardly it can be discharged into a manifold defined by shrouds at the tips of the blades which maintains the thermodynamic advantage of avoiding reintroduction of the removed fluid to the flow. The embodiment is, however, limited to relatively low speed machines because of additional loading on components caused by a shroud clearance seal which rubs against the housing of the machine. Referring to FIGS. 12 and 13, axial and tangential views of the embodiment are provided. Blades 100 each include a peripheral shroud 102 and a clearance seal 104 which, as can be best observed in FIG. 13, contacts outer housing or casing 106. Clearly these seals 104 create a radial force in the rotor blades. At high speeds the force may be sufficient to cause catastrophic damage to the blades. Thus, slower blade speeds are indicated. FIG. 13 also provides a good view of the movement of the collected boundary fluid 107 through conduit 108 into manifold area 110 defined by shroud 102, casing 106 and seals 104. Fluid escapes from manifold area 110 through ports 112 of which there are at least one and preferably many. Withdrawn fluid is employed for sundry things but is not returned to the flow.

In an alternate embodiment of outward transport, the fluid is merely discharged to the clearance space and allowed to create a pressure wall which assists in preventing pressurized fluid from the pressure side from migrating back to the suction side and helps alleviate Tip Vortex Blockages. Those of skill in the art will recognize the benefit of the arrangement but will also note that the more important teaching herein is to avoid reintroduction of the viscous fluid to the flow. Thus, this embodiment is not as favored as the foregoing.

It should be understood that the terms "immediately upstream" and "just ahead" of or "upstream of a condition causing a separation" are intended to convey that the boundary layer should be removed or lessened in thickness close enough to the separation causing phenomenon to prevent that occurrence. It may not be necessary to remove the layer precisely before that phenomenon to avoid separation. And while precise removal is optimal, avoidance of separation is paramount and provides the benefits of the invention.

As is well known to the art, compressors with counter-rotating blade rows can produce higher pressure ratios for a given number of blade rows than more conventional compressors in which rotating and stationary blade rows alternate. This is because only the moving blade rows add energy to the flow, the stationary ones are limited to deflection of the flow and its diffusion.

Limitations in overall attainable pressure ratios are due to restriction in the number of rotating blades that can be driven in these otherwise efficient machines. The pressure ratio attainable from two or possibly three counter-rotating blades is simply not enough for many commercial applications.

Figure 14:
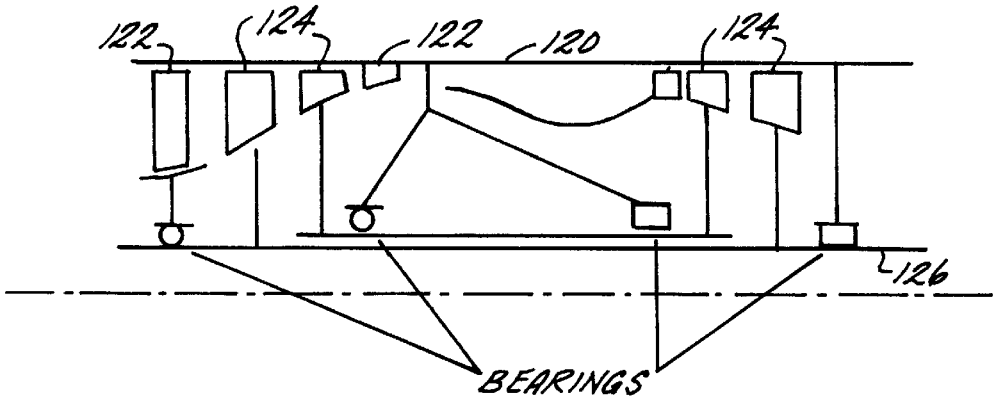
FIG. 14 is a schematic representation of a counter-rotating compressor with stationary blade rows upstream and downstream of the counter-rotating pair.

Coupling a counter-rotating blade machine, however, with the thermodynamically efficient and pressure rise enhancing procedure and apparatus discussed above, yields a commercially viable, low cost, light weight machine. Two counter-rotating blade rows, with or without a stator between them can be employed with equally beneficial results. The compressor can be configured with or without stationary blade rows upstream and downstream of the rotating pair, without significant difference in mechanical complexity, since the stationary blade rows are supported by the compressor casing. A schematic illustration of the arrangements for such compressors is shown in FIG. 14.

In general the layout of the compressor is conventional, housing 120 supports the stationary blade rows or stators 122 and the counter-rotating blade rows or rotors 124 are supported on an axial drive train 126. The components are mounted in known ways.

By employing the single radial passage transport structure and a boundary layer removal configuration as discussed above and illustrated in FIGS. 8, 9 and 10, diffusion can be increased thus increasing the total output and the efficiency of the counter-rotating machine of the invention. The avoidance of separation and alleviation of increasing entropy of the system allows the two counter rotating blade rows to produce pressure rise comparable to a multiple blade row conventional rotating/stationary machine. This is achieved while reducing the number of components in the machine and reducing cost and weight.

Determining the exact locations for boundary layer removal are as discussed hereinabove.

In order to assure the increased performance of this embodiment it is necessary to impart a tangential velocity in the inlet guide vanes against the motion of rotor 1 and to remove an equal tangential velocity from the exit guide vanes. So doing yields velocity triangles (see FIG. 15) that are symmetric in the sense that the flow deflections in the two moving blade rows are equal in magnitude. These parameters ensure that the machine will achieve maximum diffusion. Maximum diffusion facilitates outputs greater than conventional counter-rotating machines and makes them commercially viable.

The temperature rise of a compressor is given by the Euler equation in terms of the changes in tangential velocity across the moving blade rows. The expression is $$T_2 - T_1 = \frac{U}{C_p}(v_2 - v_1)$$

where U is the velocity of the moving blades, $C_p$ is the specific heat of the gas being compressed, and $v_2$ and $v_1$, respectively, are the tangential velocities of the fluid entering and leaving the blade row. The pressure ratio of the compressor is then related to this temperature rise and the change in entropy during the compression process. If the compression is ideal or isentropic, $$\frac{P_2}{P_1} = \left(\frac{T_2}{T_1}\right)^{\frac{\gamma}{\gamma}-1}$$

where $\gamma$ is the ratio of specific heats at constant pressure and at constant temperature. It is essential to this invention that the temperature and hence the pressure, both are considered to be at stagnation values in stationary coordinates and that they only increase across moving blade rows and not across stationary ones. The latter consideration is required because for stationary blade rows, U=0. Thus, the temperature rise or pressure ratio per blade row is maximized by using only rotating blade rows.

The relationship between the blade and fluid velocities is conveniently expressed as a set of velocity triangles (FIG. 15) which are drawn for a configuration with stators upstream and downstream of the rotating blade pair.

Figure 15:
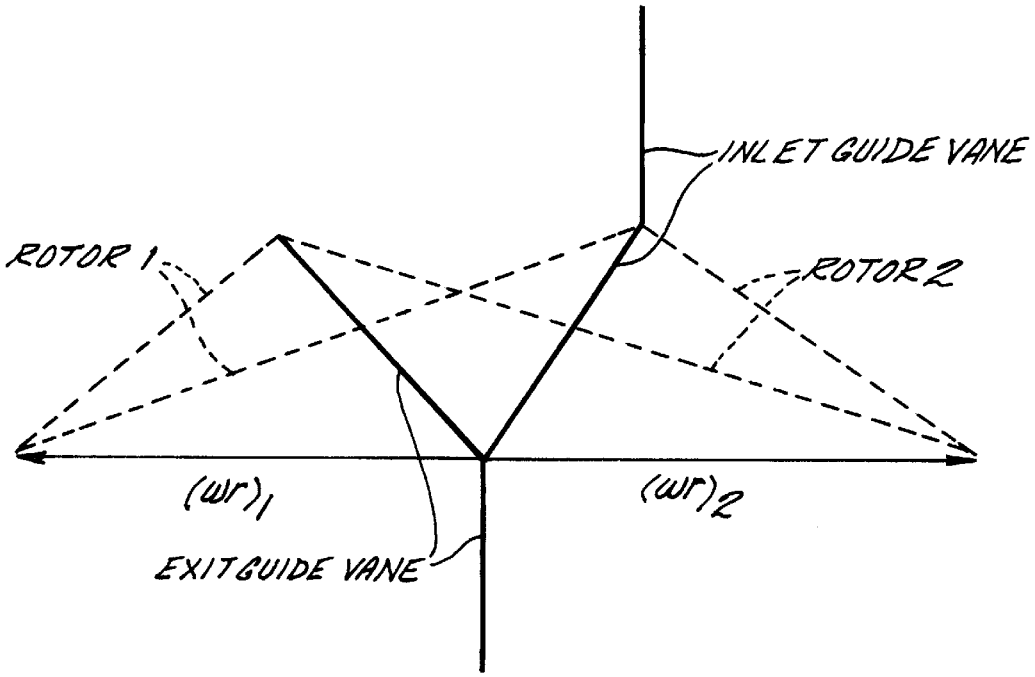
FIG. 15 is an illustration showing velocity triangles for a counter-rotating compressor with inlet and exit stator blades, and balanced diffusion in the two rotors.

Perusing FIG. 15, the solid lines indicate velocities in stationary coordinates while dashed lines indicate velocities relative to the moving blades. For purposes of exemplification, it has been assumed that the velocities of the two rotating blade rows are equal but opposite in direction, consistent with counter-rotation compressor technology. The FIGURE illustrates, as above stated that by imparting a tangential velocity in the inlet guide vanes, against the motion of rotor 1, and removing an equal tangential velocity in the exit guide vanes, the velocity triangles can be made symmetric in the sense that the flow deflections in the two moving blade rows are equal in magnitude. This concludes that the diffusion required of the two blade rows is the same. Thus, the temperature rise of the pair of counter-rotating blade rows is just twice that of a single rotating blade row with comparable diffusion, and twice that of a conventional compressor stage consisting of rotating and stationary blade rows. Moreover, for such symmetrical velocity triangles, the change in tangential velocity for each moving blade row is approximately equal to the blade velocity, so that the Euler equation yields:

$$T_2 - T_1 = 2\frac{U^2}{C_p}$$

For sea level static conditions, $T_1$=300K. Air is $C_p$=1000 Joule/kgK. A typical blade speed, as limited by structural factors, is 500 m/s, so that $T_2$-$T_1$ is approximately 500K. The corresponding isentropic pressure ratio is then 31. This is comparable to the overall pressure ratio of modem aircraft engines but in a machine having significantly less weight and bulk and which can be manufactured less expensively.

To achieve this performance the blade rows must be capable of producing the flow deflections implied by the velocity triangles of FIG. 15, without incurring unacceptable losses. For compressors it is conventional to describe this requirement in terms of a Diffusion Factor for the blade row. It is defined as $$D = 1 - \frac{V_2}{V_1} + \frac{v_2 - v}{2\sigma V_1}$$

where V is the total velocity relative to the blade row, v is the tangential velocity as noted above, and σ is the ratio of the chordwise length of the blades to their peripheral spacing. For the velocity triangles shown above, if the deflection through the inlet guide vanes is 45 degrees, it is readily observed that $V_1/V_2$=2.36, $V_1$=1.58U, $v_2$-$v_1$=U, and the resulting D is $$D = 0.553 + \frac{0.316}{\sigma}$$

Thus, if the "solidity" is near unity, D must be near 0.8. From empirical information it is known that the maximum acceptable value of σ without boundary layer control is more nearly 0.5. It has been found, however, that in counter-rotating machines employing boundary layer control of the type taught herein, values of D as large as about 0.8, are acceptable and provide increased output and efficiency in the counter-rotating machine having only two counter-rotating blade pairs.

While the preferred embodiments have been shown and described, various modifications and substitutions may be made thereto without departing from the spirit and scope of the invention. Accordingly, it is to be understood that the present invention has been described by way of illustration and not limitation.

What is claimed is:

1. An improved counter-rotating compression machine comprising:

a housing containing at least two counter-rotating compressor blade rows, each compressor blade row having a plurality of compressor blades;

a boundary layer collector associated with at least one of said compressor blades;

at least one passage in said at least one compressor blade which is associated with said boundary collector, said passage being in communication with said collector and leading to a location away from the flow of said compression machine.

2. An improved counter-rotating compression machine as claimed in claim 1 wherein said at least one passage is a single passage.

3. An improved counter-rotating compression machine as claimed in claim 2 wherein said passage has a matched centrifugal pressure gradient variation to a variation of a stagnation pressure relative to moving blades in the rotating blade rows.

4. An improved counter-rotating compression machine as claimed in claim 2 wherein said collector is a slot.

5. An improved counter-rotating compression machine as claimed in claim 2 wherein said collector is a scoop.

6. An improved counter-rotating compression machine as claimed in claim 2 wherein said collector is a porous structure.

7. An improved counter rotating compression machine comprising:

a housing having a compressor section and a turbine section;

at least one rotating turbine blade row in said turbine section;

two rotating compressor blade rows rotatably mounted in said compressor section, said compressor blade rows being counterrotating relative to each other and each row including a plurality of compressor blades;

a boundary layer collector associated with at least one of said compressor blades;

a passage connected with said collector within said at least one of said compressor blades, said passage leading to a location away from the flow of said compression machine.

* * * * *

UNITED STATES PATENT AND TRADEMARK OFFICE

CERTIFICATE OF CORRECTION

PATENT NO. : 5,904,470

DATED : May 18, 1999

INVENTOR(S) : Jack L. Kerrebrock, et al

It is certified that error appears in the above-identified patent and that said Letters Patent is hereby corrected as shown below:

Column 1, line 5, insert the following: --This invention was made with government support under Grant Number F49620-96-1-0266 awarded by the Air Force. The government has certain rights in the invention.--

Signed and Sealed this

First Day of February, 2000

*Attest:*

*Attesting Officer*

Q. TODD DICKINSON

*Acting Commissioner of Patents and Trademarks*